US007342236B2

(12) United States Patent
Burtner et al.

(10) Patent No.: US 7,342,236 B2
(45) Date of Patent: Mar. 11, 2008

(54) FLUID-COOLED ION SOURCE

(75) Inventors: David Matthew Burtner, Fort Collins, CO (US); Scott A. Townsend, Fort Collins, CO (US); Daniel E. Siegfried, Fort Collins, CO (US); Viacheslav V. Zhurin, Fort Collins, CO (US)

(73) Assignee: Veeco Instruments, Inc., Woodbury, NY (US)

( * ) Notice: Subject to any disclaimer, the term of this patent is extended or adjusted under 35 U.S.C. 154(b) by 115 days.

(21) Appl. No.: 11/061,254

(22) Filed: Feb. 18, 2005

(65) Prior Publication Data

US 2005/0248284 A1 Nov. 10, 2005

Related U.S. Application Data

(60) Provisional application No. 60/547,270, filed on Feb. 23, 2004.

(51) Int. Cl.
*H01J 7/24* (2006.01)
*H01J 49/10* (2006.01)

(52) U.S. Cl. ..... 250/426; 250/424; 250/423 R; 315/111.41; 315/111.81; 313/362.1

(58) Field of Classification Search ..... None
See application file for complete search history.

(56) References Cited

U.S. PATENT DOCUMENTS 4,129,772 A * 12/1978 Navratil et al. ..... 219/121.36
4,385,979 A * 5/1983 Pierce et al. ..... 204/298.09
4,562,355 A * 12/1985 Keller et al. ..... 250/423 R
4,862,032 A 8/1989 Kaufman et al.
5,576,600 A * 11/1996 McCrary et al. ..... 315/111.81
5,889,371 A 3/1999 Boyarsky et al.
5,973,447 A * 10/1999 Mahoney et al. ..... 313/359.1
6,608,431 B1 8/2003 Kaufman
7,025,863 B2 * 4/2006 Seeli et al. ..... 204/298.41

(Continued)

OTHER PUBLICATIONS

INTLVAC Inc., Mark II Ion Source, Water-Cooling Retro-Fit, [online], [retrieved Jun. 10, 2005], Retrieved from the INTLVAC company website using Internet <URL: http://www.intlvac.com/PDF/water_cooling_upgrade.pdf>, (4 pages), Canada.

(Continued)

*Primary Examiner*—Nikita Wells
(74) *Attorney, Agent, or Firm*—Hensley Kim & Holzer, LLC

(57) ABSTRACT

An ion source is cooled using a cooling plate that is separate and independent of the anode. The cooling plate forms a coolant cavity through which a fluid coolant (e.g., liquid or gas) can flow to cool the anode. In such configurations, the magnet may be thermally protected by the cooling plate. A thermally conductive material in a thermal transfer interface component can enhance the cooling capacity of the cooling plate. Furthermore, the separation of the cooling plate and the anode allows the cooling plate and cooling lines to be electrically isolated from the high voltage of the anode (e.g., using a thermally conductive, electrically insulating material). Combining these structures into an anode subassembly and magnet subassembly can also facilitate assembly and maintenance of the ion source, particularly as the anode is free of coolant lines, which can present some difficulty during maintenance.

29 Claims, 14 Drawing Sheets

U.S. PATENT DOCUMENTS

2002/0163289 A1 11/2002 Kaufman et al.
2005/0248284 A1 11/2005 Burtner et al.

OTHER PUBLICATIONS

Commonwealth Scientific Corporation, Guide to Operations for the One-Meter Linear End-Hall Ion Source with Hollow Cathode Electron Source, (Jul. 1999), pp. 30; 77-78.
Veeco Instruments, Inc., 20 cm Linear End Hall Technical Manual, (2002).
International Searching Authority; Korean Intellectual Property Office as Receiving Office; Written Opinion of the International Searching Authority (Form PCT/ISA/237) for international application No. PCT/US2007/060546; Aug. 7, 2007; 13 pages.
Interantional Searching Authority; Korean Intellectual Property Office as Receiving Office; International Search Report (Form PCT/ISA/210) for international application No. PCT/US2007/060546; Aug. 7, 2007; 3 pages.

* cited by examiner

FLUID-COOLED ION SOURCE

RELATED APPLICATIONS

The present application claims benefit of U.S. Provisional Application No. 60/547,270, entitled "Water-cooled Ion Source" and filed Feb. 23, 2004, specifically incorporated by reference herein for all that it discloses and teaches.

TECHNICAL FIELD

The invention relates generally to ion sources, and more particularly to fluid-cooled ion sources.

BACKGROUND

Ion sources generate a large amount of heat during operation. The heat is a product of the ionization of a working gas, which results in a high-temperature plasma in the ion source. To ionize the working gas, a magnetic circuit is configured to produce a magnetic field in an ionization region of the ion source. The magnetic field interacts with a strong electric field in the ionization region, where the working gas is present. The electrical field is established between a cathode, which emits electrons, and a positively charged anode, and the magnet circuit is established using a magnet and a pole piece made of magnetically permeable material. The sides and base of the ion source are other components of the magnetic circuit. In operation, the ions of the plasma are created in the ionization region and are then accelerated away from the ionization region by the induced electric field.

The magnet, however, is a thermally sensitive component, particularly in the operating temperature ranges of a typical ion source. For example, in typical end-Hall ion sources cooled solely by thermal radiation, discharge power is typically limited to about 1000 Watts, and ion current is typically limited to about 1.0 Amps to prevent thermal damage particularly to the magnet. To manage higher discharge powers, and therefore higher ion currents, direct anode cooling systems have been developed to reduce the amount of heat reaching the magnet and other components of an ion source. For example, by pumping coolant through a hollow anode to absorb the excessive heat of the ionization process, discharge powers as high as 3000 Watts and ion currents as high as 3.0 Amps may be achieved. Alternative methods of actively cooling the anode have been hampered by the traditional difficulties of transferring heat between distinct components in a vacuum.

There are also components in an ion source that require periodic maintenance. In particular, a gas distribution plate through which the working gas flows into the ionization region erodes during operation or otherwise degenerates over time. Likewise, the anode must be cleaned when it becomes coated with insulating process material, and insulators must be cleaned when they become coated with conducting material. As such, certain ion source components are periodically replaced or serviced to maintain acceptable operation of the ion source.

Unfortunately, existing approaches for cooling the ion source require coolant lines running to and pumping coolant through a hollow anode. Such configurations present obstacles for constructing and maintaining ion sources, including the need for electrical isolation of the coolant lines, the risk of an electrical short through the coolant from the anode to ground, degradation and required maintenance of the coolant line electrical insulators, and the significant inconvenience of having to disassemble the coolant lines to gain access to serviceable components, like the gas distribution plate, the anode, and various insulators.

SUMMARY

Implementations described and claimed herein address the foregoing problems by cooling the ion source using a cooling plate that is separate and independent of the anode. In this manner, the cooling plate and cooling lines may be electrically isolated from the high voltage of the anode while allowing easy access, disassembly, and re-assembly of the serviceable components during maintenance. In such configurations, the magnet may be thermally protected by the cooling plate. Furthermore, configuring these structures in discrete subassemblies can facilitate assembly and maintenance of the ion source.

In one implementation, an ion source includes a pole piece that is magnetically coupled to a magnet. An anode is positioned between the pole piece and the magnet relative to an axis. A cooling plate is positioned between the anode and the magnet relative to the axis to conduct heat away from the anode to a coolant. The cooling plate forms a coolant cavity through which the coolant can flow. The anode is separable from the cooling plate.

In another implementation, an ion source includes an anode and a cooling plate. The cooling plate is positioned in thermally conductive contact with the anode to conduct heat away from the anode to a coolant. The cooling plate forms a coolant cavity through which the coolant can flow. The cooling plate is separable from the anode.

In yet another implementation, a method of operating an ion source having an anode subassembly and a magnet subassembly is provided. The anode subassembly includes an anode and the magnet subassembly including a magnet and a cooling plate. The cooling plate forms a coolant cavity through which coolant can flow. The anode subassembly is separable from the magnet subassembly. Coolant is provided to flow through the coolant cavity to conduct heat away from the anode to the coolant.

In yet another implementation, an ion source includes an anode subassembly and a magnet subassembly. The anode subassembly includes an anode. The magnet subassembly includes a magnet and a cooling plate. The cooling plate forms a coolant cavity through which the coolant can flow. One or more subassembly attachments hold the anode subassembly together with the magnet subassembly. The anode subassembly and the magnet subassembly may be separated by detaching the subassembly attachments.

In yet another implementation, a method of assembling an ion source is provided. A magnet subassembly is assembled to include a magnet and a cooling plate. An anode subassembly includes an anode and is assembled using anode subassembly attachments. The magnet subassembly is combined with the anode subassembly using subassembly attachments.

In yet another implementation, a method of disassembling an ion source is provided. One or more subassembly attachments holding together an anode subassembly and a magnet subassembly are detached. The anode subassembly includes an anode. The magnet subassembly includes a magnet and a cooling plate. The anode subassembly is separated from the magnet subassembly. One or more anode subassembly attachments in the anode subassembly are detached. The anode is detached from the anode subassembly.

Other implementations are also described and recited herein.

DETAILED DESCRIPTION

Figure 1:
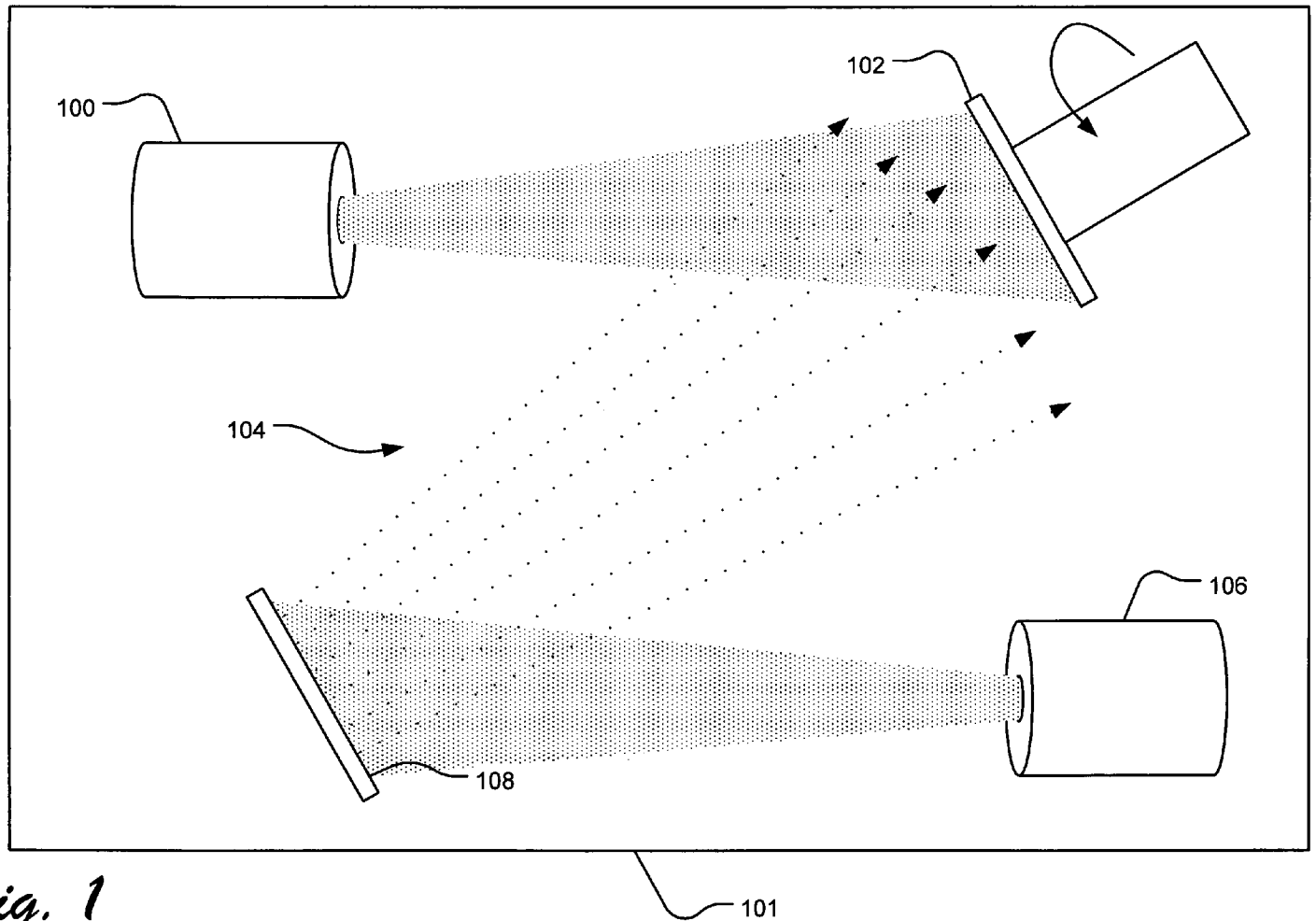
FIG. 1 illustrates an exemplary operating environment of an ion source in a deposition chamber.

FIG. 1 illustrates an exemplary operating environment of an ion source 100 in a deposition chamber 101, which typically holds a vacuum. The ion source 100 represents an end-Hall ion source that assists in the processing of a substrate 102 by other material 104, although other types of ion sources and applications are also contemplated. In the illustrated environment, the substrate 102 is rotated in the deposition chamber 101 as an ion source 106 sputters material 104 from a target 108 onto the substrate 102. The sputtered material 104 is therefore deposited on the surface of the substrate 102. In an alternative implementation, the deposited material may be produced by an evaporation source or other deposition source. It should be understood that the ion source 106 may also be an embodiment of a fluid-cooled ion source described herein. The ion source 100 is directed to the substrate 102 to improve (i.e., assist with) the deposition of the material 104 on the substrate 102.

Accordingly, the ion source 100 is cooled using a liquid or gaseous coolant (i.e., a fluid coolant) flowing through a cooling plate as described herein. Exemplary coolants may include without limitation distilled water, tap water, nitrogen, helium, ethylene glycol, and other liquids and gases. It should be understood that heat transfer between surfaces of adjacent bodies in a vacuum is less efficient than in a non-vacuum—the physical contact between two adjacent surfaces is typically minimal at the microscopic level and there is virtually no thermal transfer by convection in a vacuum. Therefore, to facilitate or improve such heat transfer, certain adjacent surfaces may be machined, compressed, coated or otherwise interfaced to enhance the thermal conductivity of the assembled components.

Furthermore, maintenance requirements and electrical leakage are also important operating considerations. Therefore, the configuration of the ion source 100 also allows an assembly of components to be easily removed from and inserted to the ion source body in convenient subassemblies, thereby facilitating maintenance of the ion source components. These components may be insulated or otherwise isolated to prevent electrical breakdown and leakage of current (e.g., from the anode through a grounded component, from the anode through the coolant to ground, etc.).

Figure 2:
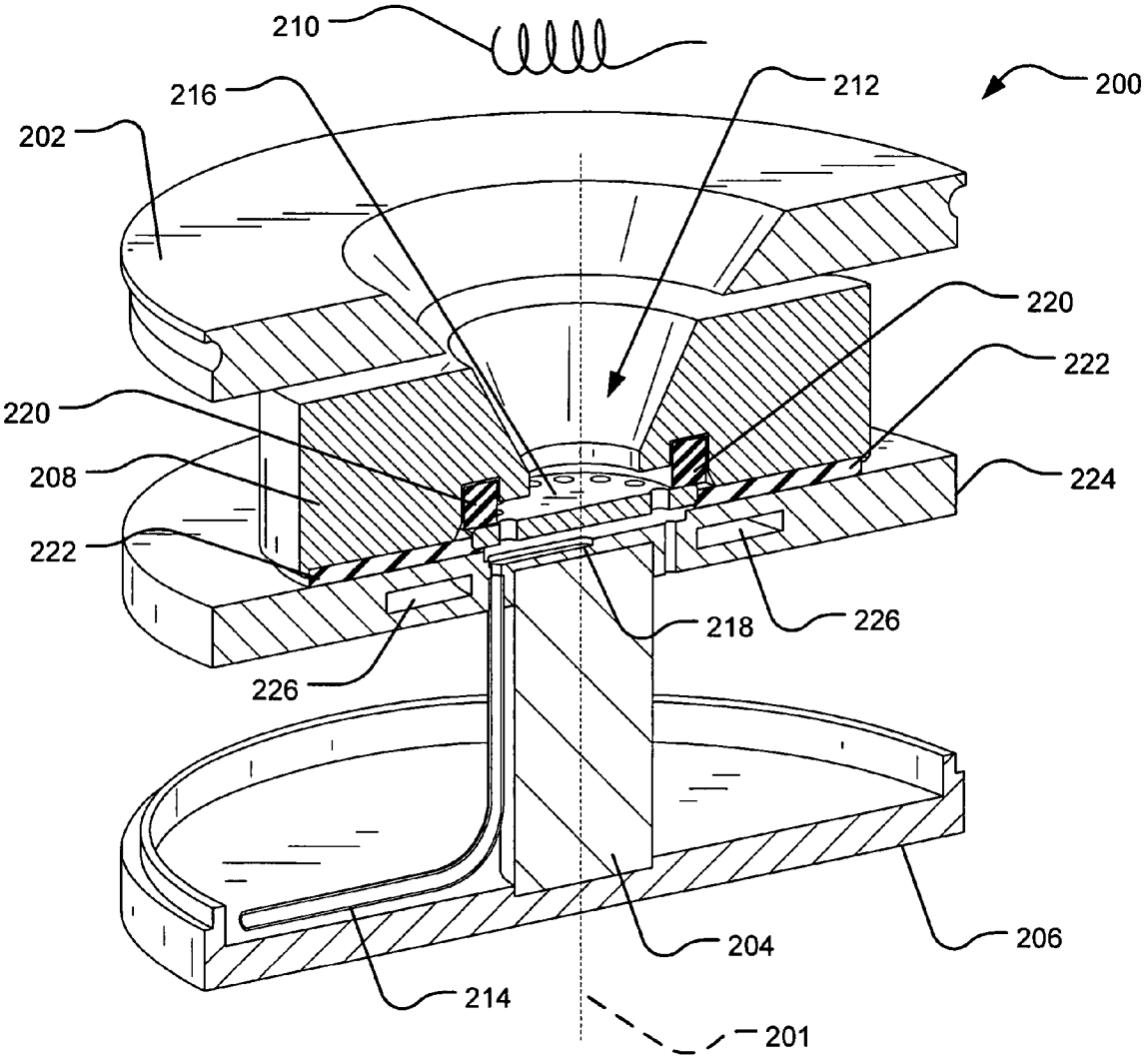
FIG. 2 illustrates a cross-sectional view of an exemplary fluid-cooled ion source.

FIG. 2 illustrates a cross-sectional view of an exemplary fluid-cooled ion source 200. The positions of the ion source components are described herein relative to an axis 201. The axis 201 and other axes described herein are illustrated to help describe the relative position of one component along the axis with respect to another component. There is no requirement that any component actually intersect the illustrated axes.

Pole piece 202 is made of magnetically permeable material and provides one pole of the magnetic circuit. A magnet 204 provides the other pole of the magnetic circuit. The pole piece 202 and the magnet 204 are connected through a magnetically permeable base 206 and a magnetically permeable body sidewall (not shown) to complete the magnetic circuit. The magnets used in a variety of ion source implementations may be permanent magnets or electromagnets and may be located along other portions of the magnetic circuit.

In the illustrated implementation, an anode 208, spaced beneath the pole piece 202 by insulating spacers (not shown), is powered to a positive electrical potential while the cathode 210, the pole piece 202, the magnet 204, the base 206, and the sidewall are grounded (i.e., have a neutral electrical potential). This arrangement sets up an interaction between a magnetic field and an electric field in an ionization region 212, where the molecules of the working gas are ionized to create a plasma. Eventually, the ions escape the ionization region 212 and are accelerated in the direction of the cathode 210 and toward a substrate.

In the implementation shown, a hot-filament type cathode is employed to generate electrons. A hot filament cathode works by heating a refractory metal wire by passing an alternating current through the hot filament cathode until its temperature becomes high enough that thermionic electrons are emitted. The electrical potential of the cathode is near ground potential, but other electrical variations are possible. In another typical implementation, a hollow-cathode type cathode is used to generate electrons. A hollow-cathode electron source operates by generating a plasma in a working gas and extracting electrons from the plasma by biasing the hollow cathode a few volts negative of ground, but other electrical variations are possible. Other types of cathodes beyond these two are contemplated.

The working gas is fed to the ionization region through a duct 214 and released behind a gas distribution plate 216 through outlet 218. In operation, the illustrated gas distribution plate 216 is electrically isolated from the other ion source components by a ceramic isolator 220 and a thermally conductive, electrically insulating thermal transfer interface component 222. Therefore, the gas distribution plate 216 is left to float electrically, although the gas distribution plate 216 may be grounded or charged to a non-zero potential in alternative implementations. The gas distribution plate 216 assists in uniformly distributing the working gas in the ionization region 212. In many configurations, the gas distribution plate 216 is made of stainless steel and requires periodic removal and maintenance. Other exemplary materials for manufacturing a gas distribution plate include without limitation graphite, titanium, and tantalum.

The operation of the ion source 200 generates a large amount of heat, which is primarily transferred to the anode 208. For example, in a typical implementation, a desirable operating condition may be on the order of 3000 Watts, 75% of which may represent waste heat absorbed by the anode 208. Therefore, to effect cooling, the bottom surface of the anode 208 presses against the top surface of the thermal transfer interface component 222, and the bottom surface of the thermal transfer interface component 222 presses against the top surface of a cooling plate 224. The cooling plate 224 includes a coolant cavity 226 through which coolant flows. In one implementation, the thermal transfer interface component 222 includes a thermally conductive, electrically insulating material, such as Boron Nitride, Aluminum Nitride or a Boron Nitride/Aluminum Nitride composite material (e.g., BIN77, marketed by GE-Advanced Ceramics). It should be understood that the thermal transfer interface component 222 may be a single layer or multi-layer interface component.

Generally, a thermally conductive, electrically insulating material having a lower elastic modulus works better in the ion source environment than materials having a higher elastic modulus. Materials with a lower elastic modulus can tolerate higher thermal deformation before material failure than higher elastic modulus materials. Furthermore, in a vacuum, even very small gaps between adjacent surfaces will greatly reduce heat transfer across the interface. Accordingly, lower elastic modulus materials tend to conform well to small planar deviations in thermal contact surfaces and minimize gaps in the interface, therefore enhancing thermal conductivity between the thermal contact surfaces.

In the illustrated implementation, the thermal transfer interface component 222 electrically isolates the cooling plate 224 from the positively charged anode 208 but also provides high thermal conductivity. Therefore, the thermal transfer interface component 222 allows the cooling plate 224 to be kept at ground potential while the anode has a high positive electrical potential. Furthermore, the cooling plate 224 cools the anode 208 and thermally isolates the magnet 204 from the heat of the anode 208.

Figure 3:
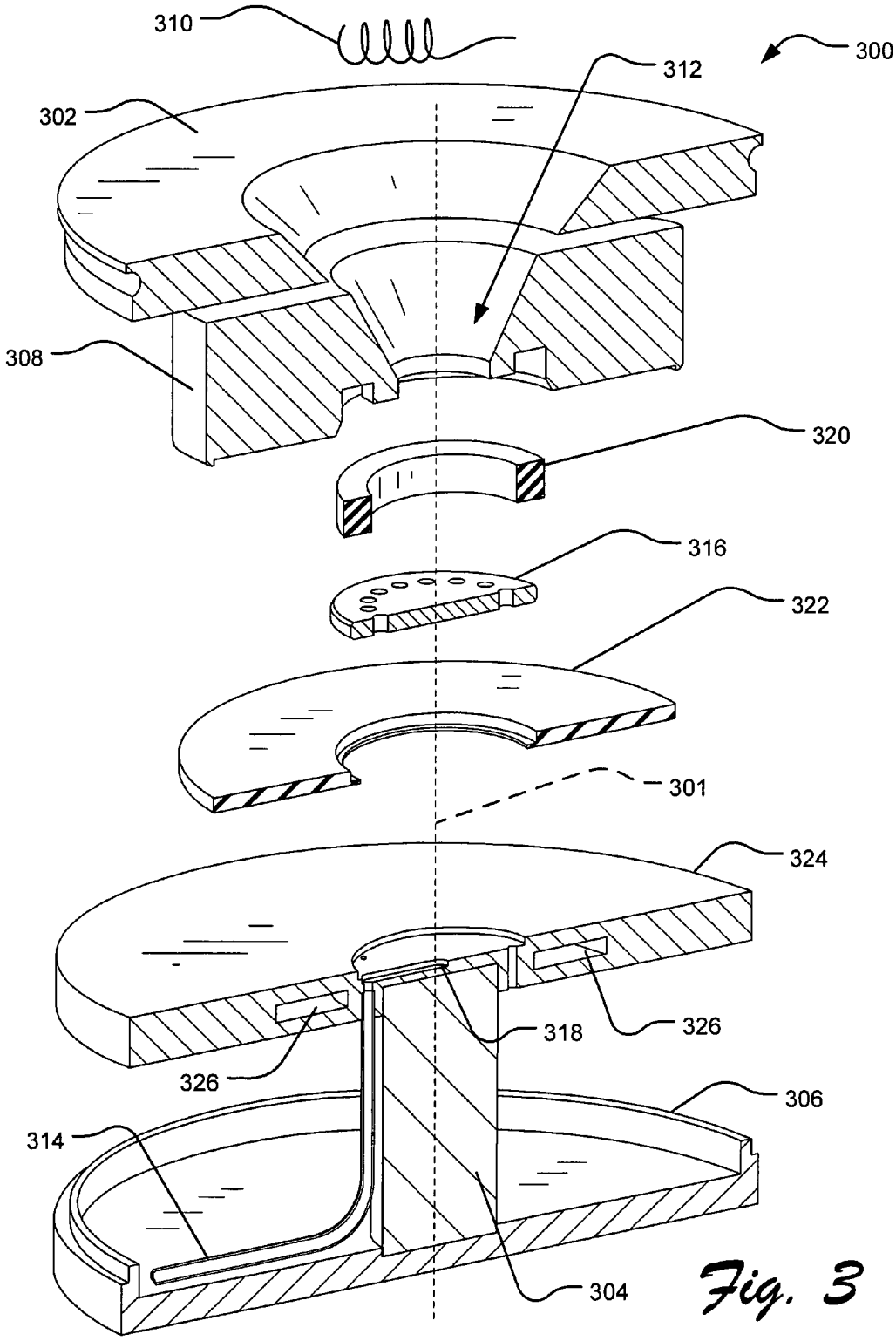
FIG. 3 illustrates an exploded cross-sectional view of an exemplary fluid-cooled ion source.

FIG. 3 illustrates an exploded cross-sectional view of an exemplary fluid-cooled ion source 300. The positions of the ion source components are described herein relative to an axis 301. A magnetically permeable pole piece 302 is coupled to a magnet 304 via a magnetically permeable base 306 and magnetically permeable sidewall (not shown). A cathode 310 is positioned outside the output of the ion source 300 to produce electrons that maintain the discharge and neutralize the ion beam emanating from the ion source 300.

A duct 314 allows a working gas to be fed through an outlet 318 and a gas distribution plate 316 to the ionization region 312 of the ion source 300. The gas distribution plate 316 is electrically isolated from the anode 308 by the insulator 320 and from the cooling plate 324 by the thermal transfer interface component 322.

An anode 308 is spaced apart from the pole piece 302 by one or more insulating spacers (not shown). In a typical configuration, the anode 308 is set to a positive electrical potential, and the pole piece 302, the base 306, the sidewall, the cathode 310 and the magnet are grounded, although alternative voltage relationships are contemplated.

A cooling plate 324 is positioned between the anode 308 and the magnet 304 to draw heat from the anode 308 and therefore thermally protect the magnet 304. The cooling plate 324 includes a coolant cavity 326 through which coolant (e.g., a liquid or gas) can flow. In the cooling plate 324 of FIG. 3, the coolant cavity 326 forms a channel positioned near the interior circumference of the doughnut-shaped cooling plate 324, although other cavity sizes and configurations are contemplated in alternative implementations. Coolant lines (not shown) are coupled to the cooling plate 324 to provide a flow of coolant through the coolant cavity 326 of the cooling plate 324.

In one implementation, the cooling plate 324, the magnet 304, the base 306, and the duct 314 are combined in one subassembly (an exemplary "magnet subassembly"), and the pole piece 302, the anode 308, the insulator 320, the gas distribution plate 316, and the thermal transfer interface component 322 are combined in a second subassembly (an exemplary "anode subassembly"). During maintenance, the anode subassembly may be separated intact from the magnet subassembly without having to disassemble the cooling plate 324 and associated coolant lines.

Figure 4:
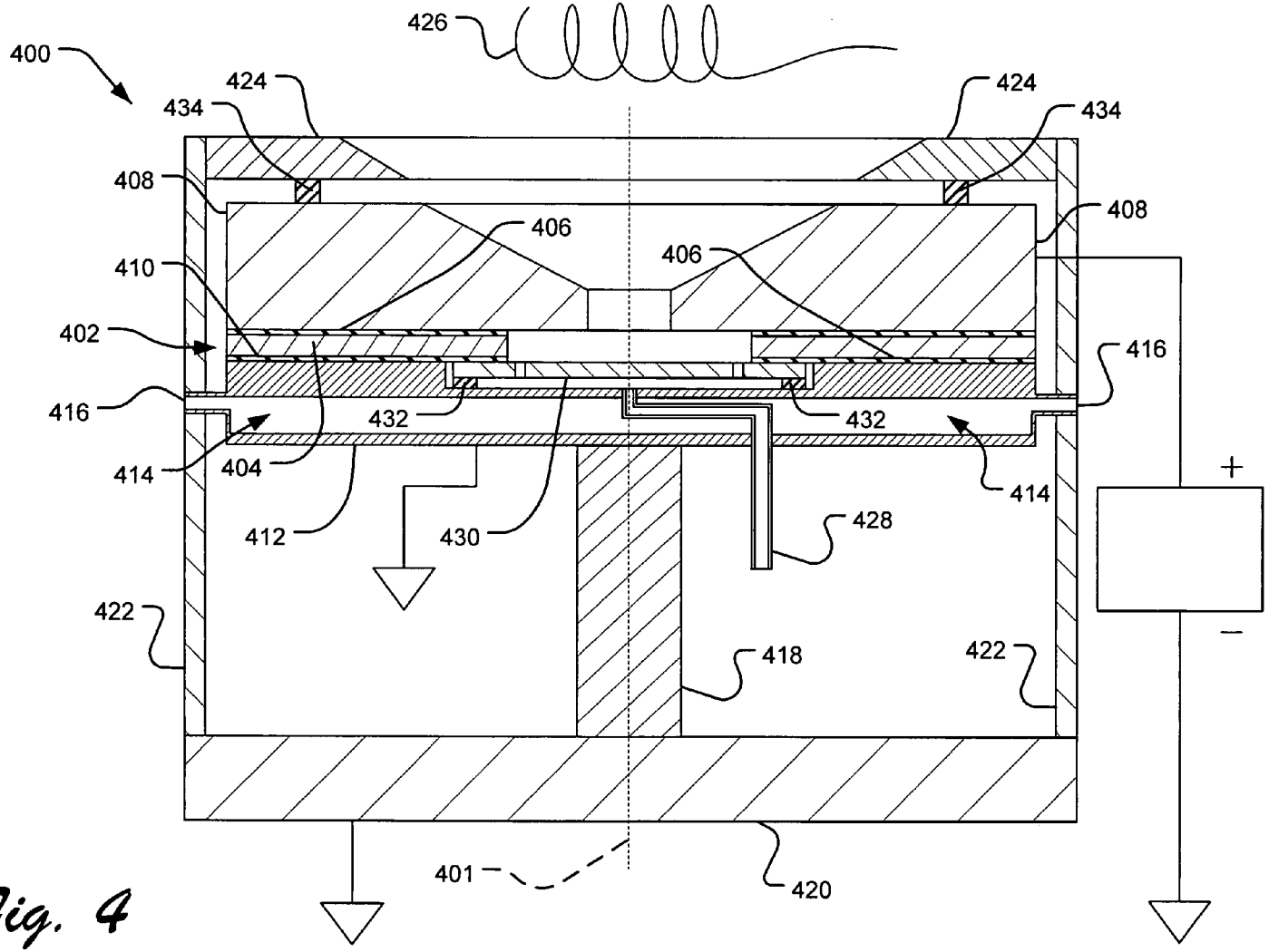
FIG. 4 illustrates a schematic of an exemplary fluid-cooled ion source.

FIG. 4 illustrates a schematic of an exemplary fluid-cooled ion source 400. The positions of the ion source components are described herein relative to an axis 401. The ion source 400 has similar structure to the ion sources described with regard to FIGS. 2-3. Of particular interest in the implementation shown in FIG. 4 is the structure of the thermal transfer interface component 402, which is formed from a metal plate 404 having a first coating 406 of a thermally conductive, electrically insulating material on the plate surface that is in thermally conductive contact with the anode 408 and a second coating 410 of the thermally conductive, electrically insulating material on the plate surface that is in thermally conductive contact with the cooling plate 412. In one implementation, the thermally conductive, electrically insulating material (e.g., aluminum oxide) is sprayed on the thermal transfer interface component 402 to coat each surface. In an alterative implementation, only one of the metal plate surfaces is so coated. In either implementation, the anode 408 is in thermally conductive contact with the cooling plate 412.

Note that the cooling plate 412 is constructed to form a coolant cavity 414. As such, coolant (e.g., a liquid or gas) can flow through coolant lines 416 and the coolant cavity 414 to absorb heat from the anode 408.

Other components of the ion source include a magnet 418, a base 420, a sidewall 422, a pole piece 424, a cathode 426, a gas duct 428, a gas distribution plate 430, insulators 432, and insulating spacers 434. The anode 408 is set at a positive electrical potential (e.g., without limitation 75-300 volts), and the pole piece 424, magnet 418, cooling plate 412, base 420, and sidewall 422 are grounded. By virtue of the insulators 432 and the electrically insulating material on the thermal transfer interface component 402, the gas distribution plate 430 floats electrically.

Figure 5:
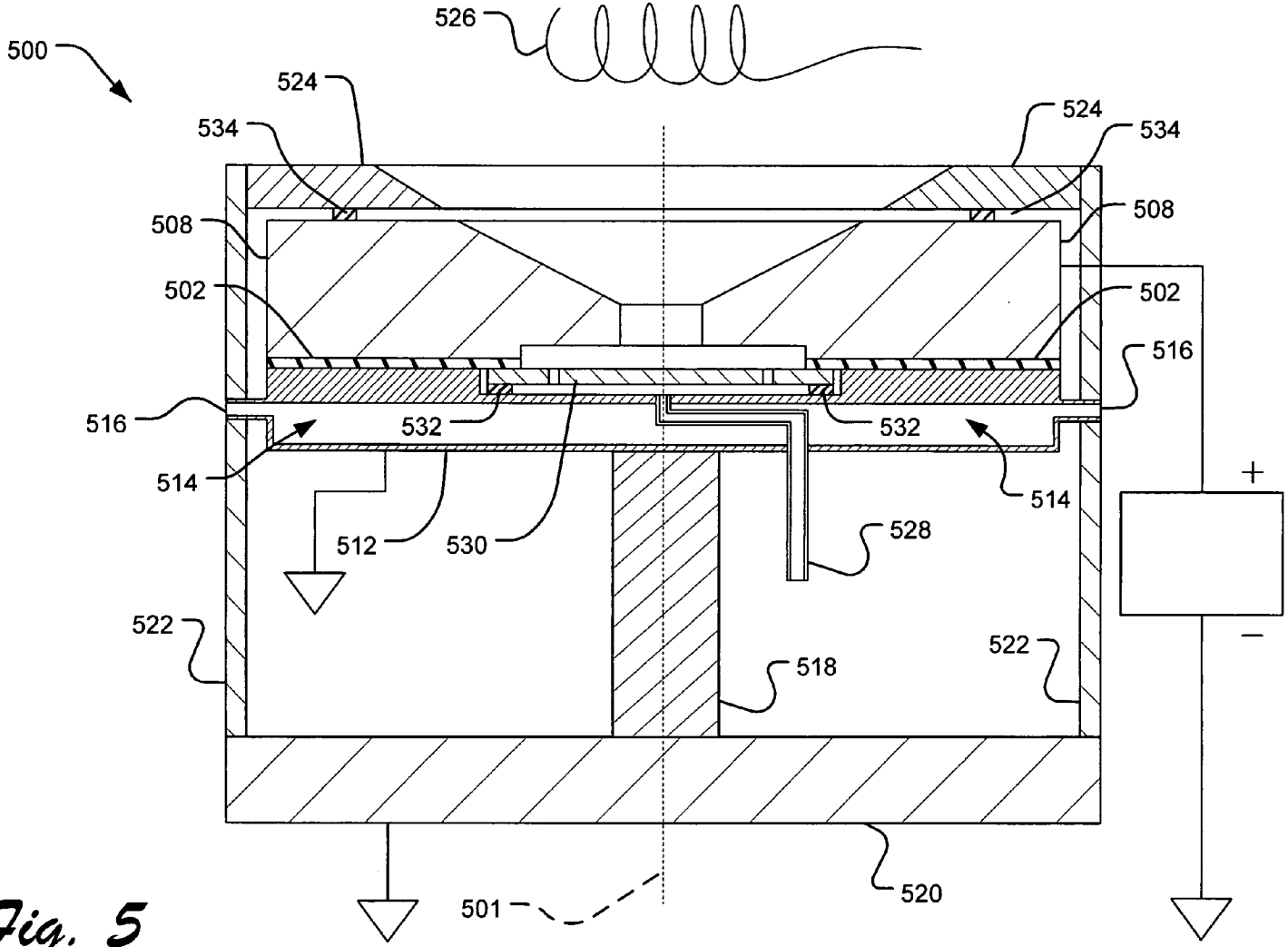
FIG. 5 illustrates a schematic of another exemplary fluid-cooled ion source.

FIG. 5 illustrates a schematic of another exemplary fluid-cooled ion source 500. The positions of the ion source components are described herein relative to an axis 501. The ion source 500 has similar structure to the ion sources described with regard to FIGS. 2-4. Of particular interest in the implementation shown in FIG. 5 is the structure of the thermal transfer interface component 502, which is formed from a coating of a thermally conductive, electrically insulating material to provide thermally conductive, electrically insulating contact between the anode 508 and the cooling plate 512. In one implementation, the thermally conductive, electrically insulating material is sprayed on the anode 508 to coat its bottom surface. In an alternative implementation, the thermally conductive, electrically insulating material is sprayed on the cooling plate 512 to coat its upper surface.

Note that the cooling plate 512 is constructed to form a coolant cavity 514. As such, coolant (e.g., a liquid or gas) can flow through coolant lines 516 and the coolant cavity 514 to absorb heat from the anode 508.

Other components of the ion source include a magnet 518, a base 520, a sidewall 522, a pole piece 524, a cathode 526, a gas duct 528, a gas distribution plate 530, insulators 532, and insulating spacers 534. The anode 508 is set at a positive electrical potential (e.g., without limitation 75-300 volts), and the pole piece 524, magnet 518, cooling plate 512, base 520, and sidewall 522 are grounded. By virtue of the insulators 532 and the electrically insulating material on the thermal transfer interface component 502, the gas distribution plate 530 floats electrically.

Figure 6:
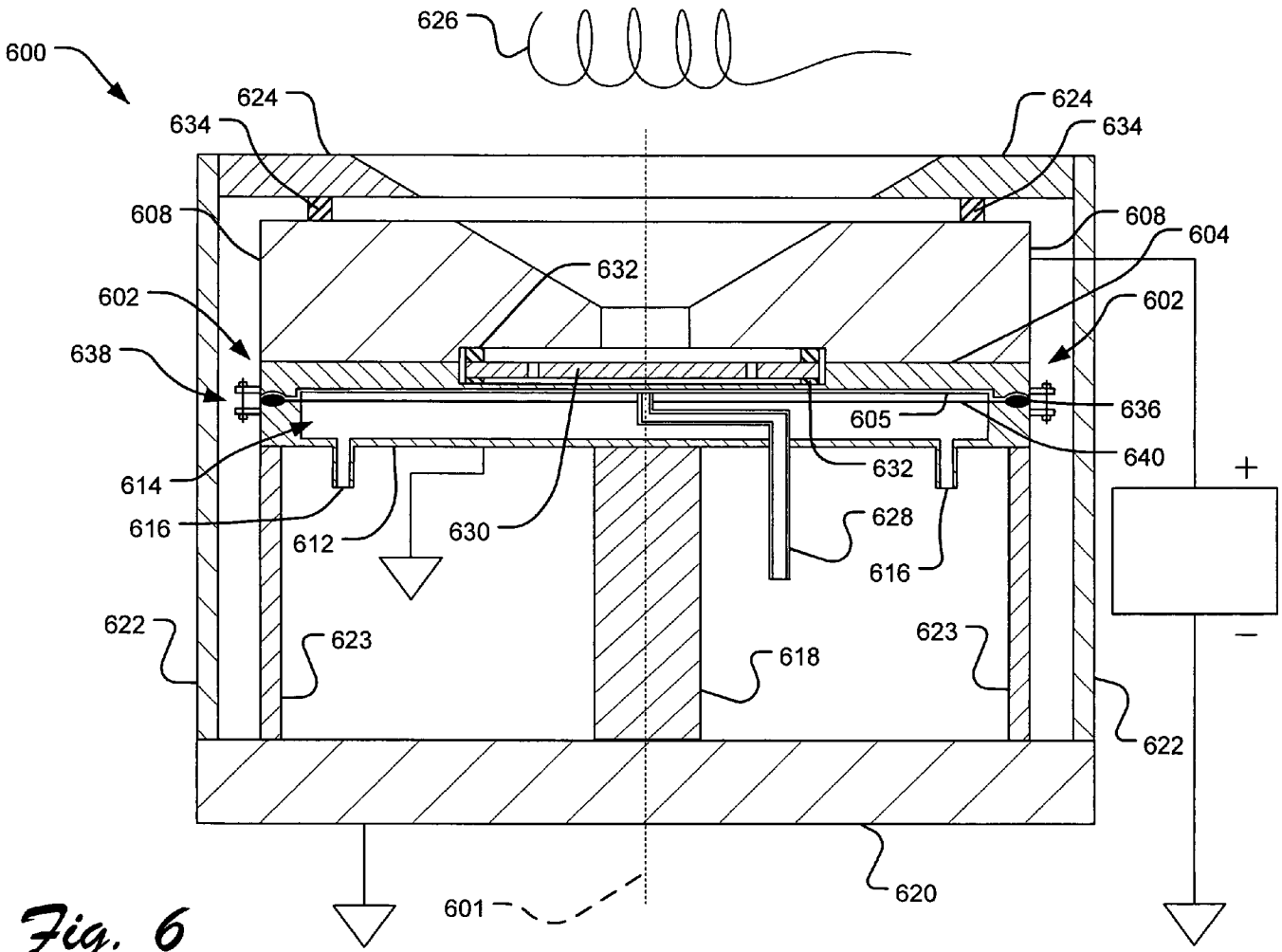
FIG. 6 illustrates a schematic of yet another exemplary fluid-cooled ion source.

FIG. 6 illustrates a schematic of yet another exemplary fluid-cooled ion source 600. The positions of the ion source components are described herein relative to an axis 601. The ion source 600 has similar structure to the ion sources described with regard to FIGS. 2-5. Of particular interest in the implementation shown in FIG. 6 is the structure of the thermal transfer interface component 602, which is formed from a thermal transfer plate 604 having a coating 605 of a thermally conductive, electrically insulating material on the plate surface. The combination of the thermal transfer plate 604 and the coating 605 provides a thermally conductive, electrically insulating interface component between the anode 608 and the coolant contained in a coolant cavity 614, which is formed by a cooling plate 612 and thermal transfer plate 604. As such, the anode 608 and the cooling plate 612 are in thermally conductive contact through the thermal transfer interface component 602 and the coolant in the coolant cavity. In one implementation, the thermally conductive, electrically insulating material is sprayed on the bottom surface (i.e., the surface exposed to the coolant cavity 614) of the thermal transfer plate 604 to facilitate thermal conduction and to reduce or prevent electrical leakage through the coolant.

Note that the cooling plate 612 is constructed to form the coolant cavity 614, which is sealed against the thermal transfer plate 604 using an 0-ring 636 and one or more clamps 638. The clamps 638 are insulated to prevent an electrical short from the thermal transfer plate 604 to the cooling plate 612. As such, coolant can flow through coolant lines 616 and the coolant cavity 614 to absorb heat from the anode 608. Note: A seam 640 separates the plate 604 and the cooling plate 612, which together contribute to the dimensions of the coolant cavity 614 in the illustrated implementation. However, it should be understood that either the plate 604 or the cooling plate 612 could merely be a flat plate that helps form the cooling cavity 614 but contributes no additional volume to the coolant cavity 614.

Other components of the ion source include a magnet 618, a base 620, a sidewall 622, supports 623, a pole piece 624, a cathode 626, a gas duct 628, a gas distribution plate 630, insulators 632, and insulating spacers 634. The anode 608 and thermal transfer plate 604 are set at a positive electrical potential (e.g., without limitation 75-300 volts), and the pole piece 624, magnet 618, cooling plate 612, base 620, and sidewall 622 are grounded. A thermally conductive material (e.g., GRAFOIL or CHO-SEAL) may be positioned between the anode 608 and the thermal transfer plate 604 to enhance heat transfer to the coolant. The gas distribution plate 630 floats electrically.

Figure 7:
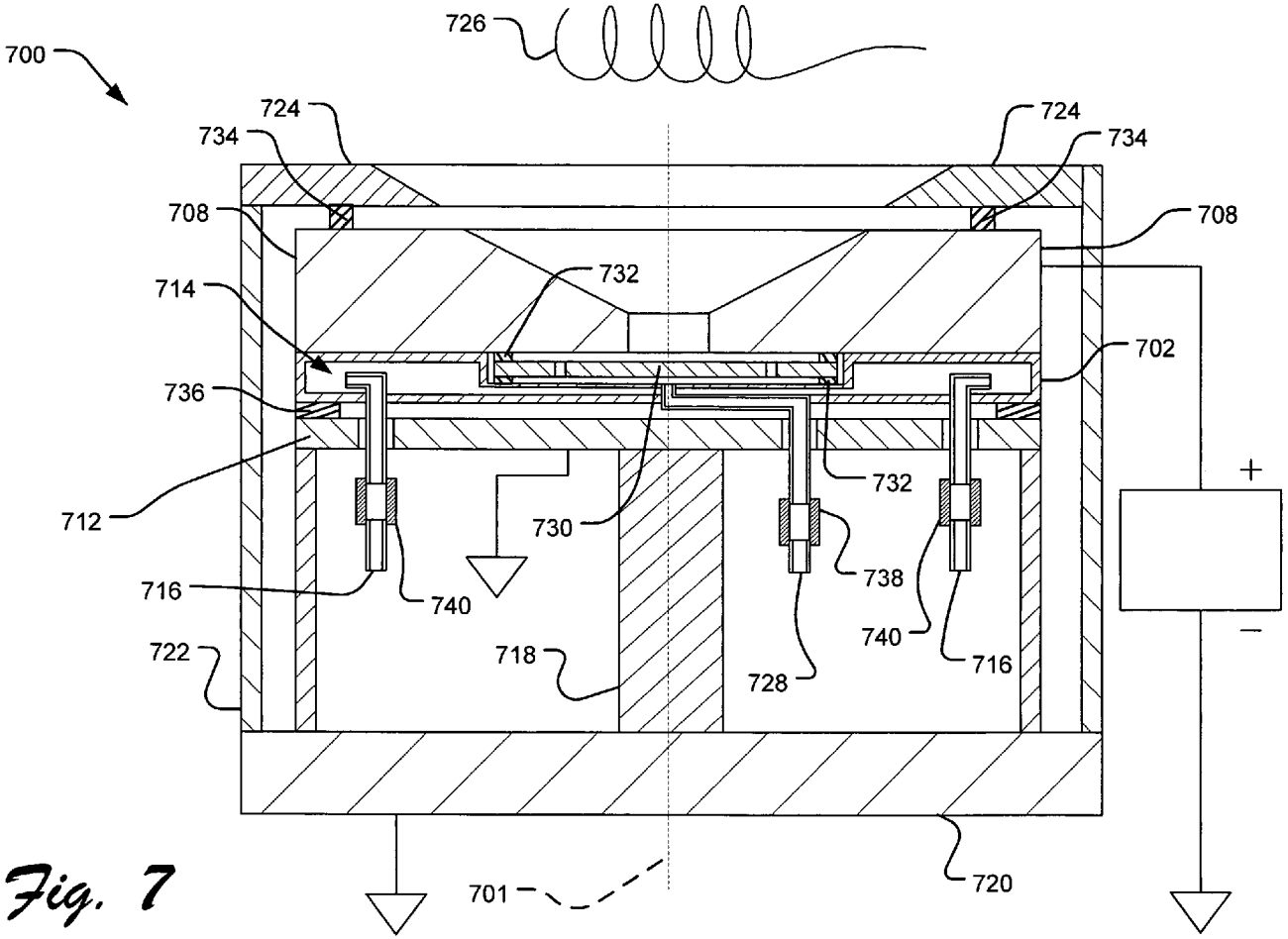
FIG. 7 illustrates a schematic of yet another exemplary fluid-cooled ion source.

FIG. 7 illustrates a schematic of yet another exemplary fluid-cooled ion source 700. The positions of the ion source components are described herein relative to an axis 701. The ion source 700 has similar structure to the ion sources described with regard to FIGS. 2-6. Of particular interest in the implementation shown in FIG. 7 is the structure of the cooling plate 702, which is not electrically insulated from the anode 708. Instead, the cooling plate 702 is insulated from substantially the rest of the ion source 700 by insulators, including insulating spacers 734, insulators 732, and insulators 736. The duct 728 and the water lines 716 are electrically isolated by isolators, 738 and 740, respectively. As such, the anode 708 and the cooling plate 702 are at a positive electrical potential, the gas distribution plate 730 is floating electrically, and most of the other components of the ion source 700 are grounded. A thermally conductive material (e.g., GRAFOIL or CHO-SEAL) may be positioned between the anode 708 and the cooling plate 702 to enhance heat transfer to the coolant.

Note that the cooling plate 702 forms a coolant cavity 714, such that coolant can flow through coolant lines 716 and the coolant cavity 714 to absorb heat from the anode 708. Other components of the ion source include a magnet 718, a base 720, a sidewall 722, a pole piece 724, a cathode 726, a gas duct 728, a gas distribution plate 730, insulators 732, and spacers 734.

Figure 8:
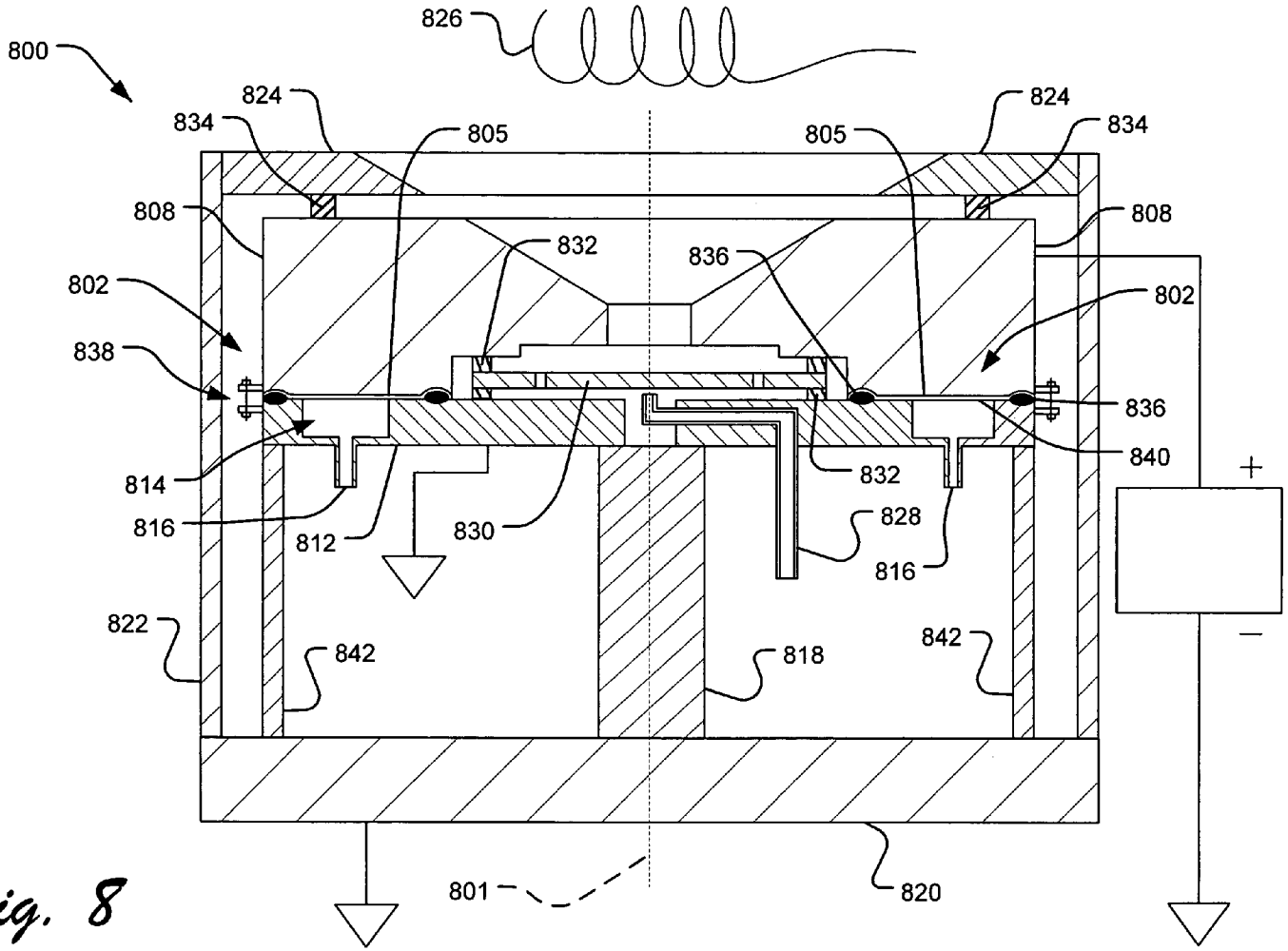
FIG. 8 illustrates a schematic of yet another exemplary fluid-cooled ion source.

FIG. 8 illustrates a schematic of yet another exemplary fluid-cooled ion source 800. The positions of the ion source components are described herein relative to an axis 801. The ion source 800 has similar structure to the ion sources described with regard to FIGS. 2-7. Of particular interest in the implementation shown in FIG. 8 is the structure of the thermal transfer interface component 802, which is formed from the bottom surface of the anode 808 having a coating 805 of a thermally conductive, electrically insulating material on the anode surface. The combination of the bottom surface of the anode 808 and the coating 805 provides a thermally conductive, electrically insulating interface component between the anode 808 and the coolant contained in a coolant cavity 814, wherein the coolant cavity 814 is formed by a cooling plate 812 and the anode 808. In one implementation, the thermally conductive, electrically insulating material is sprayed on the bottom surface (i.e., the surface exposed to the coolant cavity 814) of the anode 808. In the illustrated implementation, the anode 808 and the cooling plate 812 are in thermally conductive contact through the coating 805 and the coolant.

Note that the cooling plate 812 is constructed to form the coolant cavity 814, which is sealed against the anode 808 using O-rings 836 and one or more clamps 838 which are insulated to prevent an electrical short from the thermal transfer interface component 802 to the cooling plate 812. As such, coolant can flow through coolant lines 816 and the coolant cavity 814 to absorb heat from the anode 808. Note: A seam 840 separates the anode 808 and the cooling plate 812, which together contribute to the dimensions of the coolant cavity 814 in the illustrated implementation. However, it should be understood that either the anode surface could merely be flat or the cooling plate 812 could merely be a flat plate, such that one component does not contribute additional volume to the coolant cavity 814 but still contribute to forming the cavity, nonetheless.

Other components of the ion source include a magnet 818, a base 820, a sidewall 822, a pole piece 824, a cathode 826, a gas duct 828, a gas distribution plate 830, insulators 832, supports 842, and insulating spacers 834. The anode 808 is set at a positive electrical potential (e.g., without limitation 75-300 volts), and the pole piece 824, magnet 818, cooling plate 812, base 820, and sidewall 822 are grounded. The gas distribution plate 830 floats electrically.

Figure 9:
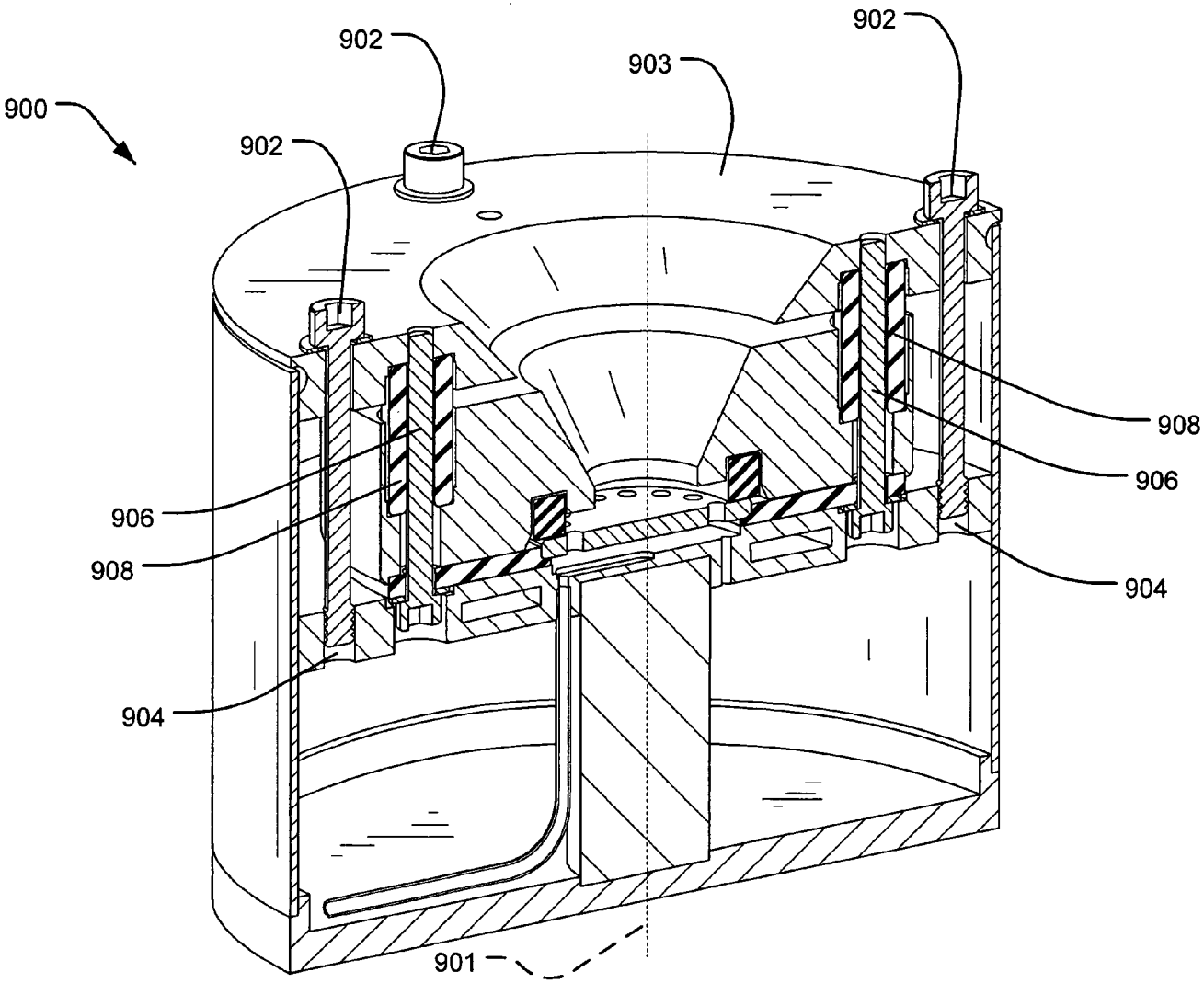
FIG. 9 illustrates a cross-sectional view of an exemplary fluid-cooled ion source.

FIG. 9 illustrates a cross-sectional view of an exemplary fluid-cooled ion source 900. The positions of the ion source components are described herein relative to an axis 901. The ion source 900 has similar structure to the ion sources described with regard to FIGS. 2-8. Of particular interest in the implementation shown in FIG. 9 is the subassembly structures of the ion source 900, which facilitate disassembly and assembly of the ion source 900.

Specifically, in the illustrated implementation, the ion source 900 includes a pole piece 903 and one or more subassembly attachments 902 (e.g., bolts) that insert into threaded holes 904 and hold an anode subassembly together with a magnet subassembly. In some implementations, the anode subassembly includes the anode and may also include the pole piece, the thermal transfer interface component, and the gas distribution plate, although other configurations are also contemplated. Likewise, in some implementations, the magnet subassembly includes the magnet and the cooling plate and may also include the base, coolant lines, and the gas duct, although other configurations are also contemplated. The sidewalls may be a component of either subassembly or an independent component that may be temporarily removed during disassembly.

In the illustrated implementation, one or more anode subassembly attachments 906 (e.g., bolts) hold the anode subassembly together by being screwed into the pole piece 903 through one or more insulators 908. The subassembly attachments 906 may be removed to disassemble the anode subassembly and to remove the thermal transfer interface component, thereby providing easy access for removal and insertion of the gas distribution plate.

Figure 10:
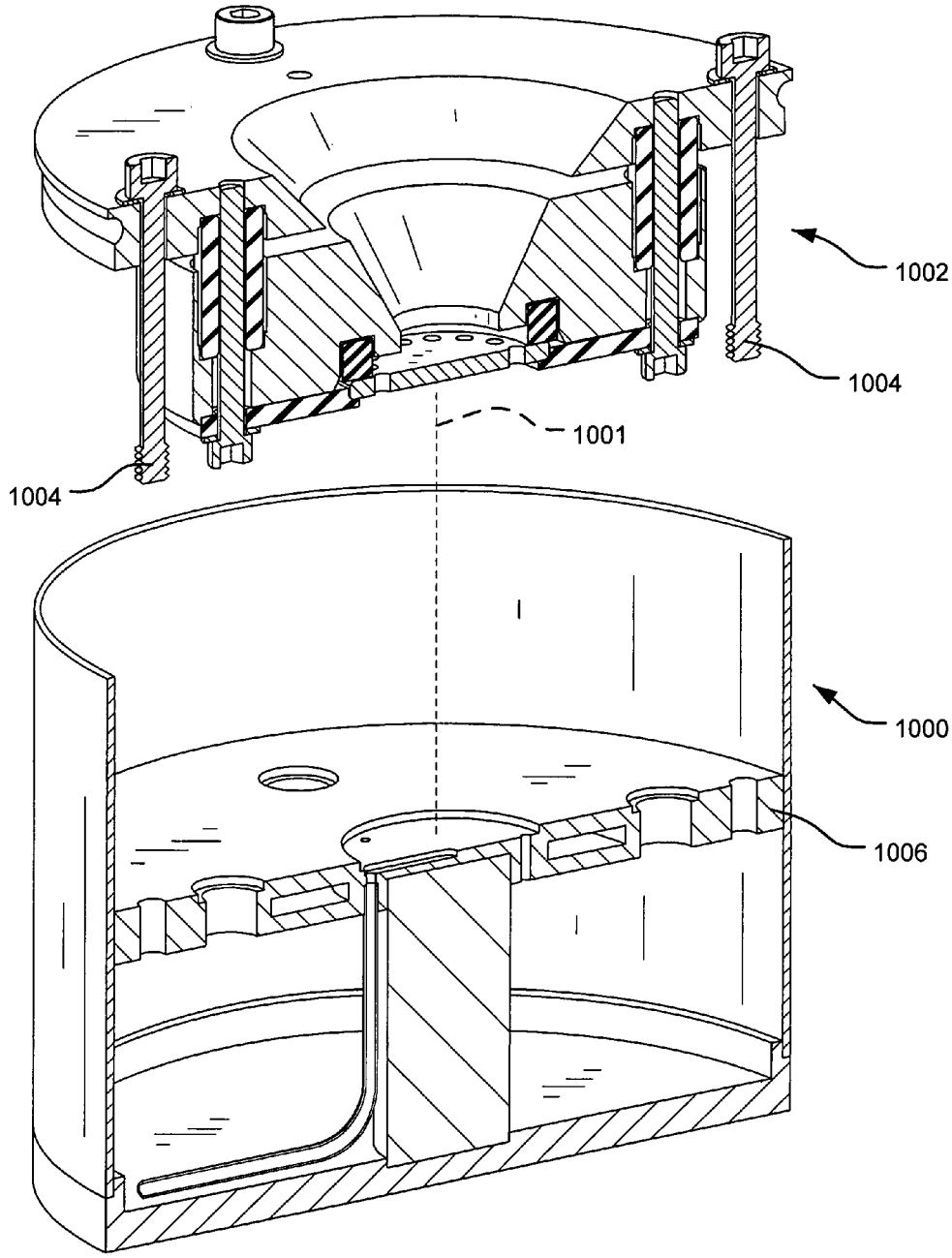
FIG. 10 illustrates an exploded cross-sectional view of an exemplary fluid-cooled ion source.

FIG. 10 illustrates an exploded cross-sectional view of an exemplary fluid-cooled ion source. The positions of the ion source components are described herein relative to an axis 1001. The magnet subassembly 1000 has been separated from the anode-subassembly 1002 by unscrewing of the subassembly bolts 1004. In the illustrated implementation, the magnet subassembly 1000 includes the cooling plate 1006.

Figure 11:
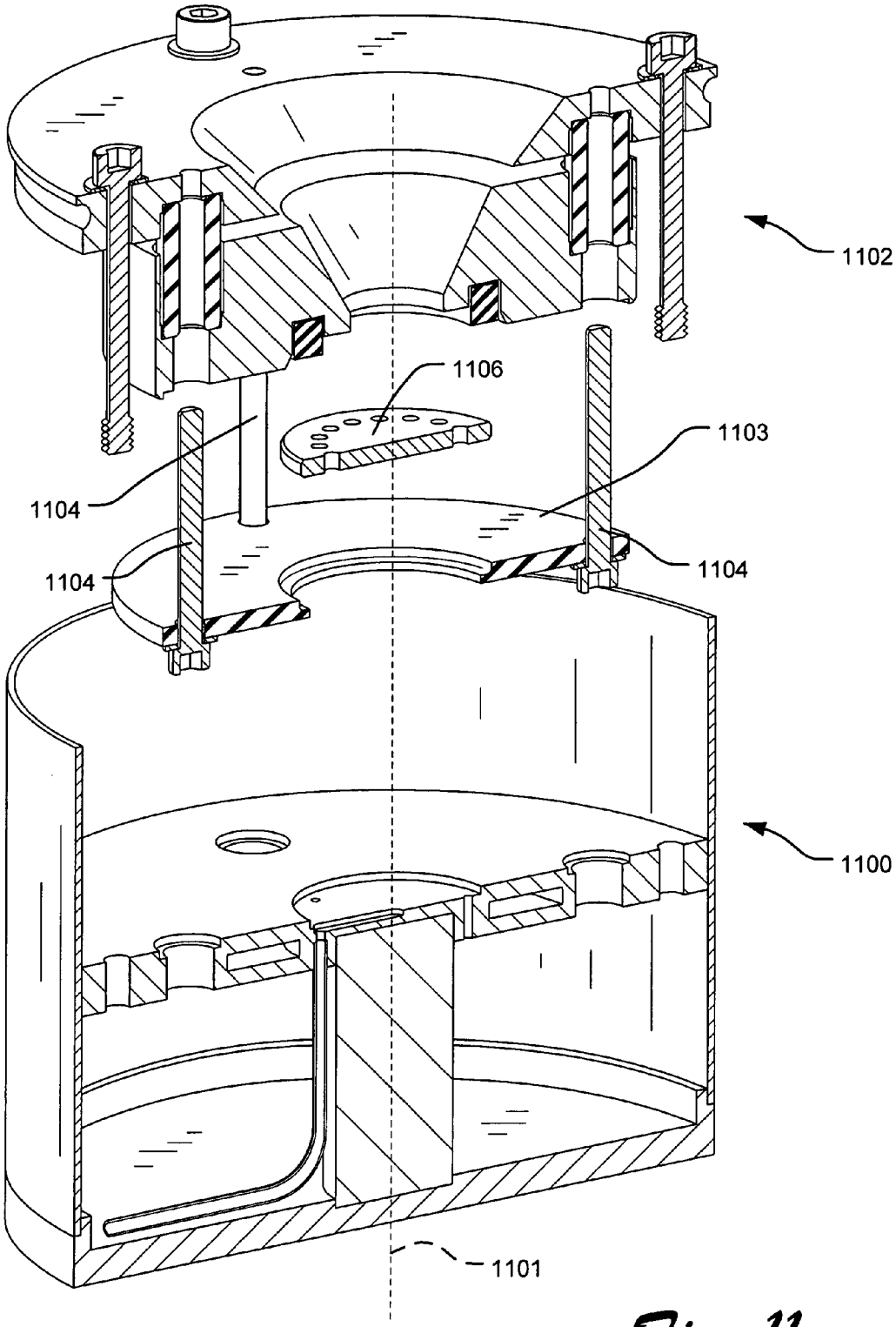
FIG. 11 illustrates an exploded cross-sectional view of an exemplary fluid-cooled ion source.

FIG. 11 illustrates an exploded cross-sectional view of an exemplary fluid-cooled ion source. The positions of the ion source components are described herein relative to an axis 1101. A magnet subassembly 1100 has been separated from an anode subassembly 1102 (as described with regard to FIG. 10), and a thermal transfer interface component 1103 has been separated from the rest of the anode subassembly 1102 by unscrewing of the anode subassembly bolts 1104, thereby providing access to the gas distribution plate 1106 for maintenance.

Figure 12:
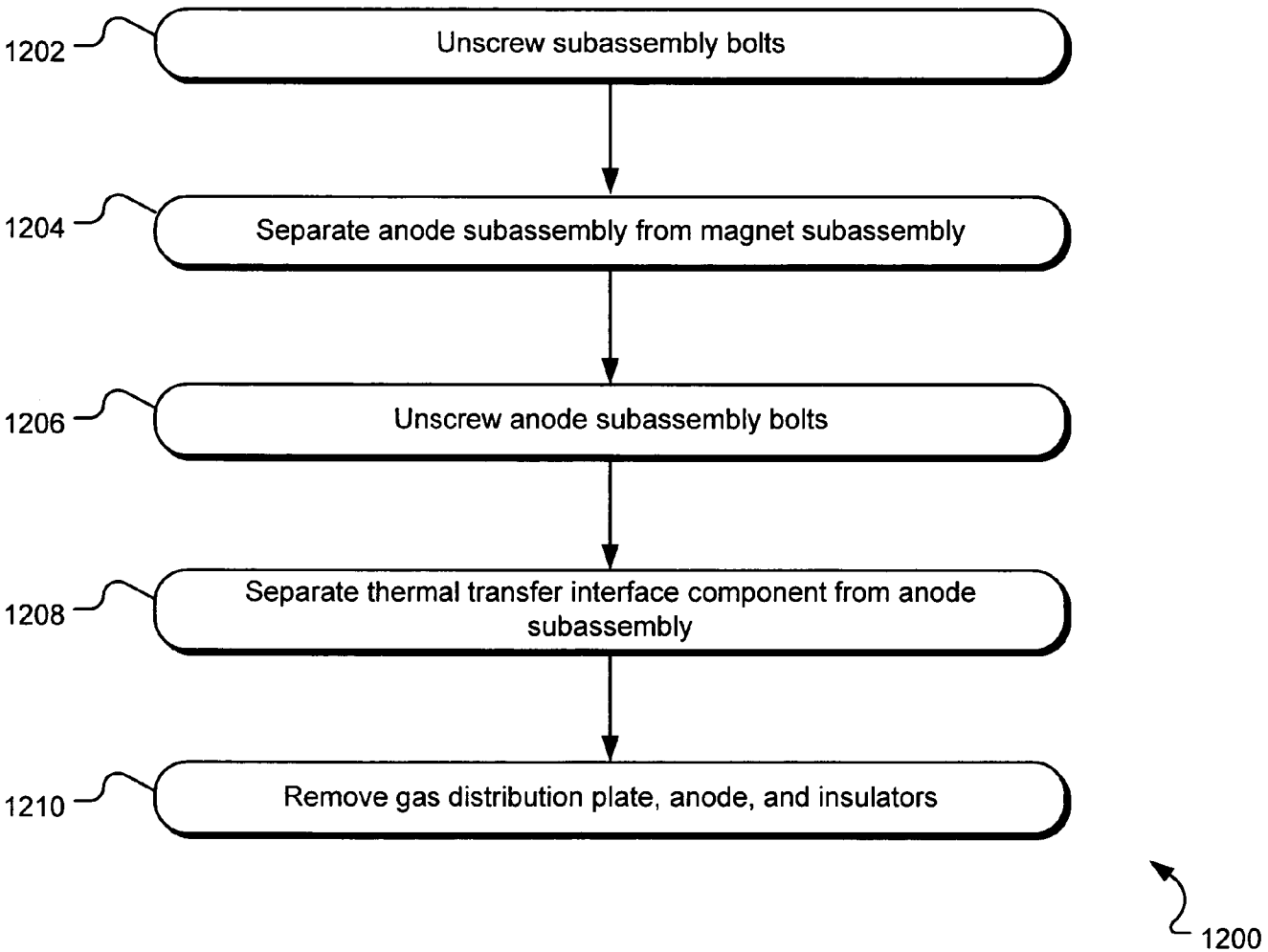
FIG. 12 depicts operations for disassembling an exemplary fluid-cooled ion source.

FIG. 12 depicts operations 1200 for disassembling an exemplary fluid-cooled ion source. A detaching operation 1202 unscrews one or more subassembly bolts that hold an anode subassembly together with a magnet subassembly. A magnet and a cooling plate reside in the magnet subassembly. The subassembly bolts in one implementation extend from the pole piece through the anode into threaded holes in the cooling plate, although other configurations are contemplated. A separation operation 1204 separates the anode subassembly from the magnet subassembly, as exemplified in FIG. 10.

In the illustrated implementation, another detaching operation 1206 unscrews one or more anode subassembly bolts that hold the thermal transfer interface component against the anode. A separation operation 1208 separates the thermal transfer interface component from the anode to provide access to the gas distribution plate. In alternative implementations, however, the gas distribution plate lies beneath the thermal transfer interface components along a central axis and is therefore exposed to access merely by the removal of the anode subassembly. As such, detaching operation 1206 and the separation operation 1208 may be omitted in some implementations. In a maintenance operation 1210, the gas distribution plate is removed from the anode subassembly, and the anode and insulators are disassembled for maintenance.

Figure 13:
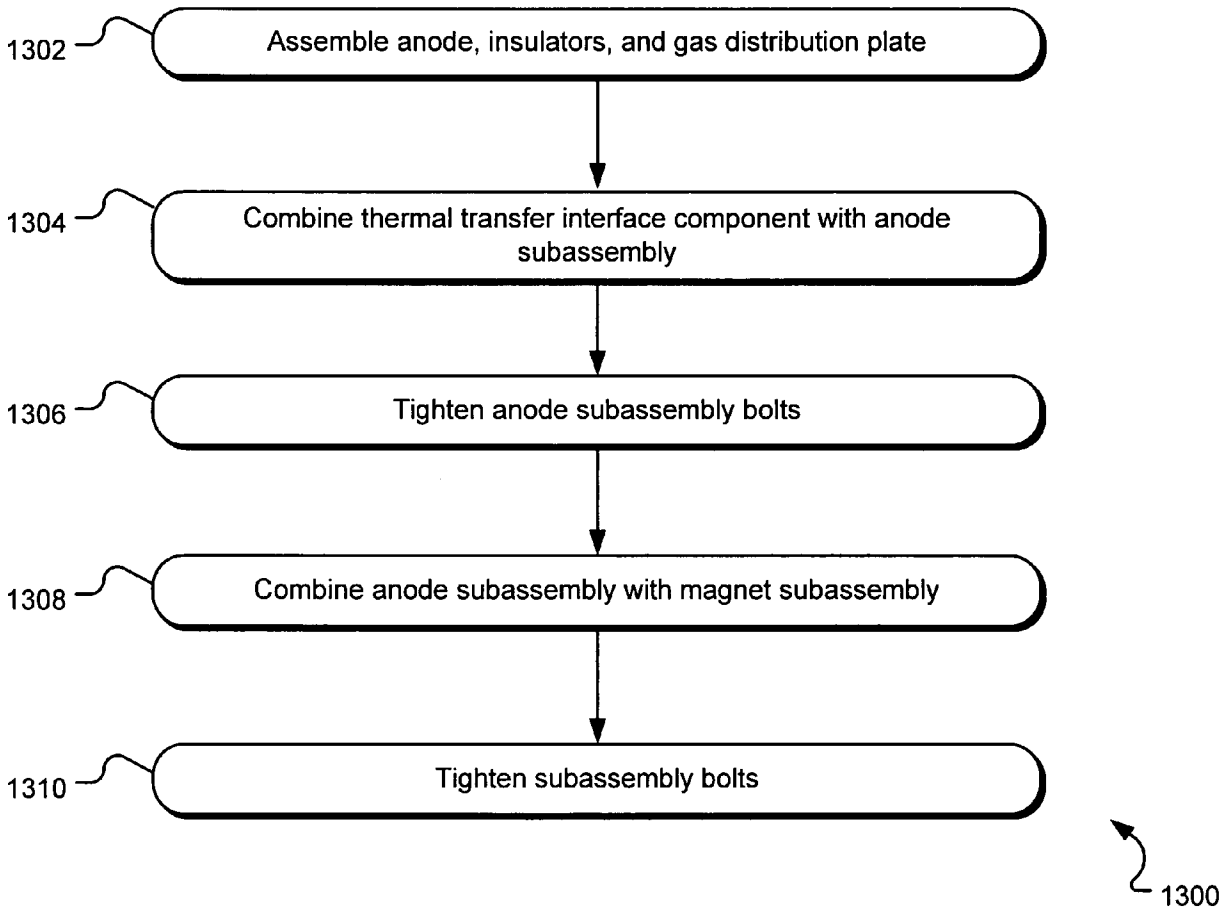
FIG. 13 depicts operations for assembling an exemplary fluid-cooled ion source.

FIG. 13 depicts operations 1300 for assembling an exemplary fluid-cooled ion source. A maintenance operation 1302 combines the insulators, anode, and gas distribution plate into the anode subassembly. In the illustrated implementation, a combination operation 1304 combines the thermal transfer interface component with the anode to hold the gas distribution plate in the anode subassembly. An attaching operation 1306 screws one or more anode subassembly bolts to hold the thermal transfer interface component against the anode. In alternative implementations, however, the gas distribution plate lies beneath the thermal transfer interface components along a central axis and is therefore exposed to access merely by the removal of the anode subassembly. As such, the combination operation 1305 and the attaching operation 1306 may be omitted in some implementations.

A combination operation 1308 combines the anode subassembly with the magnet subassembly. A magnet and a cooling plate reside in the magnet subassembly. An attaching operation 1310 screws one or more subassembly bolts to hold an anode subassembly together with a magnet subassembly. The subassembly bolts in one implementation extend from the pole piece through the anode into threaded hole in the cooling plate, although other configurations are contemplated.

Figure 14:
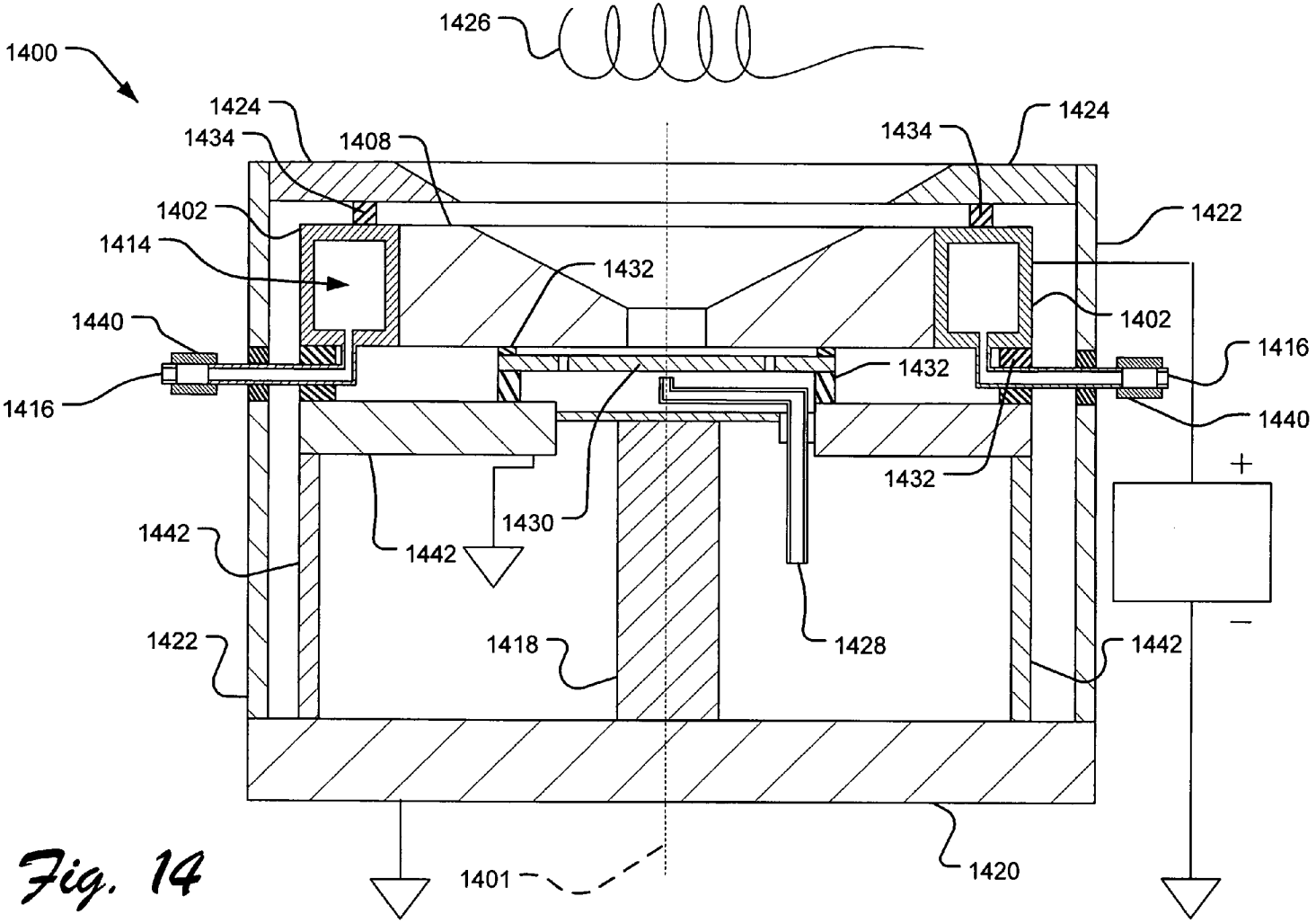
FIG. 14 depicts a schematic of yet another exemplary fluid-cooled ion source.

FIG. 14 depicts a schematic of yet another exemplary fluid-cooled ion source 1400. The positions of the ion source components are described herein relative to an axis 1401. The ion source 1400 has similar structure to the ion sources described with regard to FIGS. 2-11. Of particular interest in the implementation shown in FIG. 14 is the structure of the cooling plate 1402, which is in thermally conductive contact with the anode 1408. One advantage to the implementation shown in FIG. 14 is that the anode 1408 expands to a larger diameter as it heats. Therefore, the thermally conductive contact between the cooling plate 1402 and the anode 1408 tends to improve under the expansive pressure of the anode 1408. It should be understood that the contact interface between the cooling plate 1402 and the anode 1408 need not necessarily be planar and parallel to the axis 1401. Other interface shapes (e.g., an interlocking interface with multiple thermally conductive contact services at different orientations) are also contemplated.

Note that the cooling plate 1402 is constructed to form the coolant cavity 1414. As such, coolant can flow through coolant lines 1416 and the coolant cavity 1414 to absorb heat from the anode 1408. In an alternative implementation, the interior side of the cooling plate 1402 can be replaced with the outside surface of the anode 1408, in combination with an O-ring that seals the anode 1408 and the cooling plate 1402 to form the cooling cavity 1414 (similar to the structure in FIG. 8).

Other components of the ion source include a magnet 1418, a base 1420, a sidewall 1422, a pole piece 1424, a cathode 1426, a gas duct 1428, a gas distribution plate 1430, insulators 1432, supports 1442, and insulating spacers 1434. The anode 1408 and the cooling plate 1402 are set at a positive electrical potential (e.g., without limitation 75-300 volts), and the pole piece 1424, magnet 1418, base 1420, and sidewall 1422 are grounded. The gas distribution plate 1430 is insulated and therefore floats electrically.

In the illustrated implementation, the cooling plate 1402 is in electrical contact with the anode 1408 and is therefore at the same electrical potential as the anode 1408. As such, the coolant lines 1416 are isolated from the positive electrical potential of the cooling plate 1402 by isolators 1440. In an alternative implementation, a thermally conductive thermal transfer interface component (not shown) may be placed between the cooling plate 1402 and the anode 1408 to facilitate heat transfer. If the thermal transfer interface component is an electrically conductive material (such as GRAFOIL or CHO-SEAL), the cooling plate 1402 will be at the same electrical potential as the anode 1408. Alternatively, if the thermal transfer interface component is an electrically insulating material (such as Boron Nitride, Aluminum Nitride or a Boron Nitride/Aluminum Nitride composite material), the cooling plate 1402 is electrically insulated from the electrical potential on the anode 1408. As such, the cooling plate 1402 may be grounded and isolators 1440 are not required. In either case, whether the cooling plate 1402 and the anode 1402 are in direct physical contact or there exists a thermal transfer interface component between them (whether electrically conducting or insulating), they are still in thermally conductive contact because heat is conducted from the anode 1408 to the cooling plate 1402.

It should be understood that logical operations described and claimed herein may be performed in any order, unless explicitly claimed otherwise or a specific order is inherently necessitated by the claim language.

The above specification, examples and data provide a complete description of the structure and use of exemplary embodiments of the invention. Since many embodiments of the invention can be made without departing from the spirit and scope of the invention, the invention resides in the claims hereinafter appended. Furthermore, structural features of the different embodiments may be combined in yet another embodiment without departing from the recited claims.

What is claimed is:

1. An ion source including a pole piece magnetically coupled to a magnet and an anode positioned between the pole piece and the magnet relative to an axis, the ion source comprising:

a cooling plate positioned between the anode and the magnet on the axis to indirectly conduct heat away from the anode to a coolant, wherein the cooling plate forms a coolant cavity through which the coolant can flow and the anode is separable from the cooling plate.

2. The ion source of claim 1 further comprising:

a thermal transfer interface component positioned between the anode and the cooling plate to conduct heat from the anode to the cooling plate.

3. The ion source of claim 2 wherein the anode has a positive electrical potential and the cooling plate has a neutral electrical potential.

4. The ion source of claim 2 wherein the thermal transfer interface component comprises:

a thermally conductive, electrically insulating material.

5. The ion source of claim 2 wherein the thermal transfer interface component comprises:

a thermal transfer plate;

a first thermally conductive, electrically insulating coating on a surface of the thermally transfer plate, the first thermally conductive, electrically insulating coating being in contact with the anode; and a second thermally conductive, electrically insulating coating on another surface of the thermally transfer plate, the second thermally conductive, electrically insulating coating being in contact with the cooling plate.

6. The ion source of claim 2 wherein the thermal transfer interface component comprises:

a thermally conductive, electrically insulating coating layer positioned between the anode and the cooling plate.

7. The ion source of claim 2 wherein the thermal transfer interface component comprises:

a thermally conductive, electrically insulating coating positioned between the anode and the coolant cavity, wherein the thermally conductive, electrically insulating coating is applied to the surface of the anode exposed to the coolant cavity.

8. The ion source of claim 7 wherein the anode and the cooling plate are sealed together to form a coolant cavity through which the coolant can flow.

9. The ion source of claim 2 wherein the thermal transfer interface component comprises:

a thermal transfer plate; and a thermally conductive, electrically insulating coating layer positioned between the thermal transfer plate and the coolant cavity.

10. The ion source of claim 9 wherein the thermal transfer plate and the cooling plate are sealed together to form a coolant cavity through which the coolant can flow.

11. The ion source of claim 1 further comprising:

a gas distribution plate positioned along the axis between the cooling plate and the anode.

12. The ion source of claim 1 wherein the anode is positioned within an anode subassembly, the magnet and the cooling plate are positioned within a magnet subassembly, and the anode subassembly and the magnet subassembly are in physical contact.

13. An ion source comprising:

an anode; and a cooling plate positioned in thermally conductive contact with the anode to indirectly conduct heat away from the anode to a coolant, wherein the cooling plate forms a coolant cavity through which the coolant can flow and the cooling plate is separable from the anode.

14. The ion source of claim 13 wherein the anode has a positive electrical potential and the cooling plate has a neutral electrical potential.

15. The ion source of claim 13 further comprising a thermal transfer interface component positioned between and in thermally conductive contact with the cooling plate and the anode to conduct heat from the anode to the cooling plate.

16. The ion source of claim 15 wherein the anode and the cooling plate are at the same positive electrical potential.

17. The ion source of claim 15 wherein the anode has a positive electrical potential and the cooling plate has a neutral electrical potential.

18. The ion source of claim 13 wherein the anode is positioned within an anode subassembly, the magnet and the cooling plate are positioned within a magnet subassembly, and the anode subassembly and the magnet subassembly are in physical contact.

19. A method of operating an ion source, the method comprising:

providing an anode subassembly and a magnet subassembly, the anode subassembly including an anode and the magnet subassembly including a magnet and a cooling plate, wherein the cooling plate forms a coolant cavity through which coolant can flow and the anode subassembly is separable from the magnet subassembly; and flowing coolant through the coolant cavity to conduct heat away from the anode to the coolant indirectly.

20. The method of claim 19 further comprising maintaining the anode and the cooling plate at different electrical potentials.

21. The method of claim 19 further comprising maintaining the anode at a positive electrical potential and the cooling plate at a neutral electrical potential.

22. An ion source comprising:

an anode subassembly including an anode;

a magnet subassembly including a magnet and a cooling plate, wherein the cooling plate forms a coolant cavity through which the coolant can flow; and one or more subassembly attachments holding the anode subassembly together with the magnet subassembly, wherein the anode and the cooling plate are in contact along a thermal transfer interface the anode is indirectly cooled by the cooling plate, and the anode subassembly and the magnet subassembly are separable by detaching the subassembly attachments.

23. The ion source of claim 22 wherein the anode subassembly further includes a pole piece and the anode is positioned between the pole piece and the magnet relative to an axis when the anode subassembly and the magnet subassembly are held together by the subassembly attachments.

24. The ion source of claim 22 wherein the anode subassembly further includes a pole piece, and the anode and the pole piece are held together in the anode subassembly by one or more anode subassembly attachments.

25. A method of assembling an ion source, the method comprising:

assembling a magnet subassembly including a magnet and a cooling plate;

assembling an anode subassembly including an anode, the anode subassembly being assembled by anode subassembly attachments; and combining the magnet subassembly with the anode subassembly using subassembly attachments such that the anode and the cooling plate are in contact along a thermal transfer interface and the anode is indirectly cooled by the cooling plate.

26. The method of claim 25 wherein the cooling plate defines a coolant cavity; and the ion source further comprises a coolant line; and wherein the step of assembling the magnet subassembly further comprises connecting the coolant line with the cooling plate through which coolant flows into the coolant cavity.

27. A method of disassembling an ion source, the method comprising:

detaching one or more subassembly attachments holding together an anode subassembly and a magnet subassembly, wherein the anode subassembly includes an anode and the magnet subassembly including a magnet and a cooling plate and the anode and the cooling plate are in contact along a thermal transfer interface, and the anode is indirectly cooled by the cooling plate;

separating the anode subassembly from the magnet subassembly;

detaching one or more anode subassembly attachments in the anode subassembly; and removing the anode from the anode subassembly.

28. The method of claim 27 further comprising:

removing a gas distribution plate from the anode subassembly.

29. The method of claim 27 wherein the cooling plate defines a coolant cavity; and the magnet subassembly further comprises a coolant line connected with the cooling plate through which coolant flows into the coolant cavity; and wherein the step of separating the anode subassembly from the magnet sub assembly is performed without disconnecting the coolant line.

* * * * *

UNITED STATES PATENT AND TRADEMARK OFFICE

CERTIFICATE OF CORRECTION

PATENT NO. : 7,342,236 B2
APPLICATION NO. : 11/061254
DATED : March 11, 2008
INVENTOR(S) : David M. Burtner It is certified that error appears in the above-identified patent and that said Letters Patent is hereby corrected as shown below:

- In Claim 5, column 11, line 65 of the patent, delete “thermally” and insert --thermal--

- In Claim 5, column 12, line 2 of the patent, delete “thermally” and insert --thermal--

- In Claim 18, column 12, line 59, of the patent, replace “the” with --a--

- In Claim 22, column 13, line 16, of the patent, replace “the” with --a--

Signed and Sealed this

Twenty-third Day of September, 2008

JON W. DUDAS
*Director of the United States Patent and Trademark Office*